US012672671B2

(12) United States Patent
Bonici et al.

(10) Patent No.: US 12,672,671 B2
(45) **Date of Patent: *Jul. 7, 2026**

(54) FIRM FILTER FOR AEROSOL-GENERATING ARTICLE

(71) Applicant: PHILIP MORRIS PRODUCTS S.A., Neuchâtel (CH)

(72) Inventors: Alberto Bonici, Neuchâtel (CH); Edoardo Montanari, Bologna (IT); Emeric Grandjean, Neuchâtel (CH)

(73) Assignee: Philip Morris Products S.A., Neuchâtel (CH)

( * ) Notice: Subject to any disclaimer, the term of this patent is extended or adjusted under 35 U.S.C. 154(b) by 67 days.

This patent is subject to a terminal disclaimer.

(21) Appl. No.: 16/957,652

(22) PCT Filed: Dec. 17, 2018

(86) PCT No.: PCT/IB2018/060189

§ 371 (c)(1),
(2) Date: Jun. 24, 2020

(87) PCT Pub. No.: WO2019/130154

PCT Pub. Date: Jul. 4, 2019

(65) Prior Publication Data

US 2021/0051997 A1 Feb. 25, 2021

(30) Foreign Application Priority Data

Dec. 28, 2017 (EP) ..... 17210876

(51) Int. Cl.
*A24D 3/04* (2006.01)
*A24D 3/02* (2006.01)
(Continued)

(52) U.S. Cl.
CPC ..... *A24D 3/04* (2013.01); *A24D 3/022* (2013.01); *A24D 3/0229* (2013.01); *A24D 3/10* (2013.01); *A24D 3/17* (2020.01)

(58) Field of Classification Search
CPC ..... A24D 1/02; A24D 3/04; A24D 3/17
See application file for complete search history.

(56) References Cited

U.S. PATENT DOCUMENTS 3,224,453 A 12/1965 Mahoney et al.
3,393,684 A 7/1968 Touey et al.
(Continued)

FOREIGN PATENT DOCUMENTS

CN 101778577 A 7/2010
CN 102551208 7/2012
(Continued)

OTHER PUBLICATIONS

Menezes, Ryan. "How to Calculate Denier." Sciencing, Mar. 2, 2019, sciencing.com/how-8208660-calculate-denier.html. (Year: 2019).*
(Continued)

*Primary Examiner* — Michael H. Wilson
*Assistant Examiner* — Stephanie Lynn Moore
(74) *Attorney, Agent, or Firm* — Mueting Raasch Group

(57) ABSTRACT

An aerosol-generating article (10) includes an aerosol forming substrate (20) and a filter (30) downstream of the substrate. The filter comprises filter material comprising filaments having a linear density of about 4 denier or greater. The filter has a resistance to draw of less than 130 mmWG. Preferably, the filter has a resistance to draw of 90 mmWG or less. More preferably, the filter has a resistance to draw of 70 mmWG or less. Preferably, the density of the filter material is about 0.12 g/cm$^3$ or greater.

9 Claims, 1 Drawing Sheet

(51) Int. Cl.
*A24D 3/10* (2006.01)
*A24D 3/17* (2020.01)

(56) References Cited

U.S. PATENT DOCUMENTS

| | | | | |
|---|---|---|---|---|
| 3,658,626 | A | 4/1972 | Berger et al. | |
| 3,801,400 | A | 4/1974 | Vogt | |
| 4,619,279 | A | 10/1986 | Shiga et al. | |
| 6,776,168 | B1 | 8/2004 | Teufel | |
| 10,420,368 | B2 | 9/2019 | Shibagaki et al. | |
| 2006/0272662 | A1* | 12/2006 | Jupe | A24D 3/10 131/335 |
| 2009/0065012 | A1* | 3/2009 | Patel | A24D 1/025 131/284 |
| 2010/0242977 | A1 | 9/2010 | Tarora | |
| 2011/0108044 | A1 | 5/2011 | Norman | |
| 2011/0120481 | A1* | 5/2011 | Besso | A24D 3/048 428/401 |
| 2015/0128964 | A1 | 5/2015 | Bundren et al. | |
| 2015/0296878 | A1 | 10/2015 | Mucalo | |
| 2016/0128378 | A1 | 5/2016 | Kuersteiner et al. | |
| 2016/0192699 | A1 | 7/2016 | Martha | |
| 2016/0213057 | A1 | 7/2016 | Goldoni, Jr. et al. | |
| 2017/0354179 | A1* | 12/2017 | Sebastian | A24D 3/068 |

FOREIGN PATENT DOCUMENTS

| | | | |
|---|---|---|---|
| CN | 103763949 | A | 4/2014 |
| CN | 105764367 | A | 7/2016 |
| EP | 2229827 | | 9/2010 |
| EP | 2324722 | | 5/2011 |
| EP | 2446758 | | 5/2012 |
| EP | 3117724 | A1 | 1/2017 |
| GB | 2064293 | A | 6/1981 |
| GB | 2285908 | A | 8/1995 |
| JP | 2015-503335 | A | 2/2015 |
| JP | 2017-503477 | | 2/2017 |
| KR | 20080014893 | A | 2/2008 |
| RU | 2222242 | C2 | 1/2004 |
| WO | 2008/110931 | A2 | 9/2008 |
| WO | 20110058319 | | 5/2011 |
| WO | 2012/138630 | A1 | 10/2012 |
| WO | WO 2013/098405 | A2 | 7/2013 |
| WO | WO 2014/009498 | A1 | 1/2014 |
| WO | 20140198815 | | 12/2014 |
| WO | 20150007401 | | 1/2015 |
| WO | 2015/082651 | A1 | 6/2015 |
| WO | WO 2015/091792 | A1 | 6/2015 |
| WO | 20150124242 | | 8/2015 |
| WO | 20150181354 | | 12/2015 |
| WO | WO 2016/140307 | A1 | 9/2016 |
| WO | 20170036586 | | 3/2017 |
| WO | 20170036588 | | 3/2017 |
| WO | WO 2017/036588 | A1 | 3/2017 |
| WO | WO 2017/148773 | A1 | 9/2017 |
| WO | WO 2017/216671 | A1 | 12/2017 |

OTHER PUBLICATIONS

Extended European Search Report issued by the European Patent Office for EP 17210876.3, on Jun. 13, 2018; 7 pgs.
International Search Report and Written Opinion issued by the European Patent Office for PCT/IB2018/060189; Dec. 17, 2018; 13 pgs.
Chinese Office Action for CN Application No. 201880078597.8, issued by the Chinese National Intellectual Property Administration on Jan. 4, 2022; 16 pgs. including English translation.
Gao et al., "Study on performance of different specifications of acetate tow for medium fine cigarette," Food & Machinery, Jun. 2017;33(6): 196-200.
International Preliminary Report on Patentability for PCT/IB2018/060189, issued by the International Bureau of WIPO on Jul. 9, 2020; 7 pgs.
Huang, Handbook of Tobacco Industry, Apr. 30, 1999;263-264: 7 pgs. with English translation.
"Paper and Board—Determination of Bending Resistance," International Standard "ISO 2493-1", First Edition Nov. 15, 2010; 16 pgs.
Russian Decision to Grant for RU Application No. 2020121167, issued by the Russian Patent Office on Jun. 10, 2022; 12 gs. including English Translation.
Brazilian Office Action for BR Application No. BR112020010838-3, issued by the Brazilian Patent Office, published on Jun. 14, 2022; 7 pgs.
Japanese Office Action for JP Application No. 2020-531770, issued by the Japanese Patent Office on Jan. 18, 2023; 7 pgs. Including English translation.
Pmi R&D Evaluation Report—Date Added UCSF: Jan. 31, 2013; 75 pgs.
Tobacco Production, Chemistry and Technology, D. Layten Davis and Mark T. Nielsen, 1999; 20 pgs.
Philip Morris U.S.A. Interoffice Correspondence, Dec. 7, 1972; 8 pgs.
Notice of Opposition for EP18836889.8, Jun. 19, 2023; 17 pgs.
Notice of Opposition for EP18836889.8, Jun. 22, 2023; 23 pgs.
Decision on Final Rejection for JP 2020-535254 issued by the Japanese Patent Office on May 27, 2024; 5 pgs. including English translation.

* cited by examiner

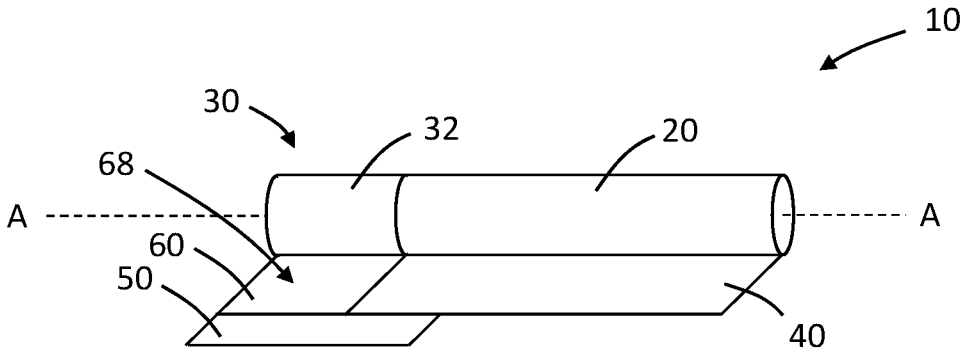
10
30
32
20
68
A
A
60
50
40

FIRM FILTER FOR AEROSOL-GENERATING ARTICLE

This application is the § 371 U.S. National Stage of International Application No. PCT/IB2018/060189, filed 17 Dec. 2018, which claims the benefit of European Application No. 17210876.3, filed 28 Dec. 2017.

This invention relates to aerosol-generating articles and filters for aerosol-generating articles that have enhanced hardness.

Aerosol-generating articles include articles that may be combusted to produce an aerosol or heated but not combusted to produce an aerosol, as well articles that may aerosolize a substrate or composition in any other suitable manner such as by chemical reaction or entraining particles in air. Regardless of the mechanism for aerosol formation, aerosol-generating articles may include a filter downstream an aerosol-forming substrate to filter one or more constituents of the aerosol.

For example, combustible aerosol-generating articles, such as cigarettes, typically have shredded tobacco, usually in cut filler form, surrounded by a paper wrapper forming a tobacco rod. A cigarette is employed by a smoker by lighting one end of the cigarette and burning the tobacco rod. The smoker then receives mainstream smoke by drawing on the opposite end or mouth end of the cigarette, which typically contains a filter. The filter is positioned to entrap some constituents of mainstream smoke before the mainstream smoke is delivered to a smoker.

Filters in aerosol-generating articles typically include filter material surrounded by a plug wrap. The plug wrap contributes to the rigidity of the filter. Plug wraps with enhanced stiffness, such as plug wraps formed from higher weight basis paper, may be used to produce firmer, more rigid filters. Plug wraps with enhanced stiffness may aid in, for example, stubbing out the combustible aerosol-generating articles due to enhanced longitudinal rigidity and may result in the perception of a higher quality product when picked up by a consumer due to enhanced radial hardness.

However, circumscribing a stiff plug wrap around filter material may present challenges. For example, equipment on filter manufacturing lines may need to be altered so that the stiffer plug wrap can be wrapped around the filter material.

Another option for enhancing filter hardness may be to increase the tow weight of the filter material employed. That is, the density of the filter material may be increased. However, increasing the density of filter material may increase filtration efficiency and not allow a desired amount of aerosol constituents to pass through the filter, resulting in an unexpected or undesired taste or experience. Resistance to draw of an aerosol-generating article employing higher density filter material may also be undesirably increased relative to article employing more standard density filter material.

It is desirable to provide a filter for use in an aerosol-generating article, wherein the filter has improved hardness. It is also desirable to provide a filter for use in an aerosol-generating article, wherein the filter has desired filter characteristics, such as a resistance to draw similar to less hard filters.

In various aspects of the present invention, there is provided an aerosol-generating article comprising an aerosol forming substrate and a filter downstream of the substrate. The filter comprises filter material comprising filaments having a linear density of about 4 denier or greater. More preferably, the filaments have a linear density of about 4 denier or greater and a density of 0.19 g/cm$^3$ or less. The filter has a resistance to draw of less than 130 mmWG. Preferably, the filter has a resistance to draw of 90 mmWG or less. More preferably, the filter has a resistance to draw of 70 mmWG or less, and may have a resistance to draw of 50 mmWG or less. Preferably, the density of the filter material is about 0.12 g/cm$^3$ or greater. Preferably, the density of the filter material is about 0.19 g/cm$^3$ or less.

It has been found that increasing the linear density of the filaments of the filter material allows for a higher density of filter material to be employed while maintaining desired filter characteristics, such as resistance to draw. The increased density of filter material may improve filter hardness.

The filter may comprise a plasticizer, which may bond fibers of the filter material together. The presence of a plasticizer may increase the density of the filter material and may result in increased filter hardness. However, increased amounts of plasticizer may increase resistance to draw. Use of higher density filaments may counteract the increase in resistance to draw associated with increased amounts of plasticizer.

Incorporation of enhanced hardness filters into aerosol-generating articles may allow the aerosol-generating articles to be perceived as being of higher quality. Enhanced filter hardness may also be advantageous when, for example, stubbing out a combustible aerosol-generating article, such as a cigarette, including the filter. For example, an enhanced hardness filter may keep a user's fingers away from the combusted end of the cigarette when the cigarette is stubbed out, because the filter may be less likely to buckle during the process of extinguishing the cigarette. Previously, increasing filter hardness tended to undesirably increase resistance to draw. However, by employing filter material comprising filaments having a linear density of 4 denier or greater, hard filters having relatively low resistance to draw may be formed.

The advantages discussed above, as well as other advantages, will be readily evident to those of skill in the art upon reading and understanding the present disclosure.

The aerosol-generating articles of the present invention may have any suitable average radial hardness. Preferably, the aerosol-generating articles have an average radial hardness of 95% or greater when measured around the filter, which was previously not achievable while maintaining desired filter properties such as resistance to draw. For example, the aerosol-generating articles may have an average radial hardness of 96% or greater, 97% or greater, or 98% or greater when measured around the filter. Preferably, the aerosol-generating articles have an average radial hardness from about 95% to about 99% when measured around the filter. As used herein, the term "radial hardness" refers to resistance to compression is a direction transverse to a longitudinal axis. Radial hardness of an aerosol-generating article around a filter may be determined by applying a load across the article at the location of the filter, transverse to the longitudinal axis of the article, and measuring the average (mean) depressed diameters of the articles. Radial hardness is given by:

$$\text{Radial hardness (\%)} = \frac{D_d}{D_S} * 100\%$$

where $D_S$ is the original (undepressed) diameter, and $D_d$ is the depressed diameter after applying a set load for a set duration. The harder the material, the closer the hardness is to 100%.

To determine the hardness of a portion (such as a filter) of an aerosol article, aerosol-generating articles should be aligned parallel in a plane and the same portion of each aerosol-generating article to be tested should be subjected to a set load for a set duration. This test is performed using a known DD60A Densimeter device (manufactured and made commercially available by Heinr. Borgwaldt GmbH, Germany), which is fitted with a measuring head for aerosol-generating articles, such as cigarettes, and with an aerosol-generating article receptacle.

The load is applied using two load applying cylindrical rods, which extend across the diameter of all of the aerosol-generating articles at once. According to the standard test method for this instrument, the test should be performed such that twenty contact points occur between the aerosol-generating articles and the load applying cylindrical rods. In some cases, the filters to be tested may be long enough such that only ten aerosol-generating articles are needed to form twenty contact points, with each smoking article contacting both load applying rods (because they are long enough to extend between the rods). In other cases, if the filters are too short to achieve this, then twenty aerosol-generating articles should be used to form the twenty contact points, with each aerosol-generating article contacting only one of the load applying rods, as further discussed below.

Two further stationary cylindrical rods are located underneath the aerosol-generating articles, to support the aerosol-generating articles and counteract the load applied by each of the load applying cylindrical rods.

For the standard operating procedure for such an apparatus, an overall load of 2 kg is applied for a duration of 20 seconds. After 20 seconds have elapsed (and with the load still being applied to the smoking articles), the depression in the load applying cylindrical rods is determined, and then used to calculate the hardness from the above equation. The temperature is kept in the region of 22 degrees Centigrade±2 degrees. The test described above is referred to as the DD60A Test. The standard way to measure the filter hardness is when the aerosol-generating article have not been consumed. Additional information regarding measurement of average radial hardness can be found in, for example, U.S. Published Patent Application Publication Number 2016/0128378.

In some preferred examples, the filters of the present invention have an average radial hardness of 90% or greater, such as 92% or greater or 94% or greater. For example, the filters of the present invention may have an average radial hardness of 95% or greater, such as 95.5% or greater. More preferably, the filters have an average radial hardness of 96% or greater, such as 97% or greater. For example, the filters of the present invention may have an average radial hardness in a range from about 95% to about 99%, such as from about 95% to about 98%.

As used herein, "diameter" is used to describe the maximum dimension in the transverse direction (transverse to the longitudinal axis) of the filter or an aerosol-generating article that includes the filter. The longitudinal axis of the filter or aerosol-generating article is in the direction of the length of the filter or aerosol-generating article. For purposes of the present disclosure, the term "radius" refers to a transverse distance from the longitudinal axis to an edge of the filter or aerosol-generating article. Typically, the filter and aerosol-generating article will be cylindrically shaped. However, the filter, the aerosol-generating article, or the filter and the aerosol-generating article do not need to be cylindrically shaped.

The aerosol-generating articles including filters of the present invention may have any suitable resistance to draw (RTD). "Resistance to draw" refers to the static pressure difference between the two ends of a specimen when it is traversed by an air flow under steady conditions in which the volumetric flow is 17.5 millilitres per second at the output end. The RTD of a specimen can be measured using the method set out in ISO Standard 6565:2002. Preferably, aerosol-generating articles including filters of the present invention have an RTD similar to conventional cigarettes.

In some preferred examples, aerosol-generating articles including filters of the present invention have an RTD from about 40 mm water gauge (mmWG) and about 200 mmWG, preferably between about 50 mmWG and about 140 mmWG, and more preferably from about 50 mmWG to about 100 mmWG. Preferably, the filters have an RTD of about 130 mmWG or less. More preferably, the filters have an RTD of about 110 mmWG or less, such as 90 mmWG or less. Even more preferably, the filters have an RTD of about 70 mmWG or less, such as about 65 mmWG or less, or about 60 mmWG or less.

The filter may have an RTD for the rod length used in the aerosol generating article, of from about 40 mm water gauge (mmWG) and about 200 mmWG, preferably between about 50 mmWG and about 140 mmWG, and more preferably from about 50 mmWG to about 100 mmWG. The filter, in the length used in the aerosol generating article, may have an RTD of 90 mmWG or less, such as 70 mmWG or less. More preferably, the filters have an RTD of 65 mmWG or less, such as 60 mmWG or less.

The filter material of the invention has preferably an RTD for a rod length of 126 mm from about 40 mm water gauge (mmWG) and about 200 mmWG, preferably between about 50 mmWG and about 140 mmWG, and more preferably from about 50 mmWG to about 100 mmWG. Preferably, the filters have an RTD of 90 mmWG or less, such as 70 mmWG or less. More preferably, the filters have an RTD of 65 mmWG or less, such as 60 mmWG. Preferably, the filter has for a rod length of 126 mm an RTD of 90 mmWG or less, such as 70 mmWG or less. More preferably, the filters have for a rod length of 126 mm an RTD of 65 mmWG or less, such as 60 mmWG or less.

In some preferred embodiments, the filter material of the invention has an RTD for a rod length from about 15 mm to about 40 mm, such as about 21 mm, of from about 40 mm water gauge (mmWG) to about 200 mmWG, preferably between about 50 mmWG and about 140 mmWG, and more preferably from about 50 mmWG to about 100 mmWG. Preferably, the filters have an RTD of 90 mmWG or less, such as 70 mmWG or less. More preferably, the filters have an RTD of 65 mmWG or less, such as 60 mmWG or less or 50 mmWG or less. Preferably, the filter has for a rod length from about 15 mm to about 40 mm, such as about 21 mm, an RTD of 90 mmWG or less, such as 70 mmWG or less, 65 mmWG or less, or 60 mmWG or less.

Filters having smaller lengths may have a lower RTD than filters having larger lengths, particularly if the filters are manufactured from the same material in the same manner. In some preferred embodiments, filters having a rod length from about 15 mm to about 40 mm, such as about 21 mm, have an RTD from about 30 mmWG to about 90 mmWG, from about 40 mmWG to about 70 mmWG, from about 40 mmWG to about 65 mmWG, or from about 40 mmWG to about 60 mmWG.

Preferably, the filters have an RTD of 90 mmWG or less, such as 70 mmWG or less, 65 mmWG or less, or 60 mmWG or less for a filter length of 21 mm. That is, the filters have an RDT of about 4.3 mmWG or less, 3.3 mmWG or less, 3.1 mmWG or less, or 2.9 mmWG or less per mm of filter length.

The filters and associated aerosol-generating articles may have any suitable relationship between RTD and average radial hardness. For example, the quotient of the value of the RTD of the filter divided by the value of the average radial hardness of the aerosol-generating article is 0.75 or less. Preferably, the quotient of the value of the RTD of the filter divided by the value of the average radial hardness of the aerosol-generating article is 0.7 or less. More preferably, the quotient of the value of the RTD of the filter divided by the value of the average radial hardness of the aerosol-generating article is 0.65 or less.

The filters and associated aerosol-generating articles may have any suitable value for (100−hardness)×RTD, where hardness is the value of the average radial hardness (%) and RTD is the value of the RTD in mmWG. For example, the filters and associated aerosol-generating articles may have a value for (100−hardness)×RTD in a range from about 40 to about 2000. Preferably, the filters and associated aerosol-generating articles have a value for (100−hardness)×RTD in a range from about 40 to about 1000; more preferably from about 40 to about 500.

The filters and associated aerosol-generating articles may have any suitable value for [(100−hardness)×RTD]/mm of filter, where (100−hardness)×RTD is as defined above and mm of filter is the length of the filter. Preferably, the filters have a value for [(100−hardness)×RTD]/mm of filter of 20 or less; more preferably 15 or less; and even more preferably, 10 or less. For example, the filters may have a value for [(100−hardness)×RTD]/mm of filter of from about 2 to about 20; preferably from about 3 to about 15; and more preferably from about 5 to about 13.

The filters of the invention may achieve a suitable hardness and resistance to draw by incorporating suitable amounts of filter material of suitable filament size when accounting for other factors such as plasticizer concentration and plug wrap properties.

Any suitable filter material may be used in accordance with the present invention. Examples of suitable filter material include cellulose esters such as cellulose acetate, polylactic acid (PLA), cellulosic material, polypropylene, or any degradable filtration media, or a combination or blend of any two or more of filter materials. In preferred embodiments, the filter material includes polymeric filter material such as polylactic acid, cellulose esters, and blends thereof. Preferably, the filter material includes a cellulose ester. Examples of cellulose esters that can be used to form filter material include cellulose acetates, cellulose propionates and cellulose butyrates with varying degrees of substitution, as well as mixed esters thereof. Examples of such mixed esters include cellulose acetate propionate, cellulose acetate butyrate, and cellulose acetate propionate butyrate. Preferably, the filter material comprises cellulose acetate.

The filter material, including the plasticizer, may have any suitable tow weight or density. Preferably, the filter material has a weight between about 5 mg/mm and about 7 mg/mm. More preferably, the filter material has a weight between about 5.5 mg/mm and about 6.5 mg/mm. Preferably, the filter has a density between about 0.11 g/cm$^3$ and about 0.2 g/cm$^3$. More preferably, the filter has a density between about 0.12 g/cm$^3$ and about 0.19 g/cm$^3$, such as between about 0.12 g/cm$^3$ and about 0.15 g/cm$^3$. Filters that have higher weights and densities tend to be harder than those having lower weights and densities. However, increased the weight or density of filter material may also tend to increase RTD to undesirable levels or may filter too much aerosol, and thus prevent a sufficient amount of aerosol from being delivered to a user.

To mitigate the effects of increased filter weight or density on RTD and filtration, the filters may comprise filaments having a linear density of 4 denier per filament or greater. Linear density of filaments used in filters may be measured by determining the mass, in grams, of the filaments per 9000 meters. Preferably, the filters of the present invention comprise filaments having a linear density of 5 denier per filament or greater, 6 denier or greater, or 7 denier or greater. For example, the filters of the present invention may comprise filaments having a linear density of about 8 denier per filament. Preferably, the filaments having linear densities described above are cellulose acetate filaments.

The filters of the present invention may have any suitable amount of plasticizer. As used herein, a "plasticizer" is a solvent, that when applied to polymeric fibers, solvent-bonds the fibers together. Examples of plasticizers include triacetin (also known as glycerol triacetate), diethylene glycol diacetate, triethylene glycol diacetate, tripropion, acetyl triethyl citrate, triethyl citrate and mixtures of one or more thereof. Preferably, the plasticizer comprises triacetin. One or more plasticizers may be mixed with, for example, polyethylene glycol and contacted with the polymeric fibers to solvent-bond the fibers together. The fibers may be contacted with a binding agent in any suitable manner. Preferably, a composition comprising the binding agent is sprayed on the polymeric fibers.

Preferably, the filters comprise 7% or more of the plasticizer, relative to the weight of the filter material. For example, the filters may comprise 7 g or more of plasticizer per 100 g of cellulose acetate, if the filter is a cellulose acetate filter. More preferably, the filter comprises 8% or more plasticizer or 9% or more plasticizer. For example, the filter may comprise about 10% plasticizer. More preferably, the filter comprises from about 7.5% by weight to about 11.5% by weight plasticizer. Preferably, the filters comprise from about 7.5% to about 10% plasticizer. For example, the filter may comprise from about 8% to about 11% plasticizer or from about 8% to about 10% plasticizer.

The inventors have discovered that the specific quantity of plasticizer of filters of the invention may lead to a filter having desirable hardness, RTD and filtration efficiency. When the amount of plasticizer exceeds about 12%, particularly if the plasticizer exceeds about 13%, the quality of the filter tends to suffer. For example, a cellulose acetate filter having greater than about 12% triacetin results in the filter having relatively large voids in the filter, which may substantially reduce the filtration efficiency and render the filter unacceptable.

By selecting an appropriate combination of filter weight or density, filament linear density and plasticizer, suitable filtration, hardness, resistance to draw may be achieved.

The filter may include a plug wrap disposed around the filter material. The plug wrap may contribute to the hardness of the filter. The plug wrap may be coated with any suitable hardness-enhancing coating composition. If the plug wrap includes a coating, the coating preferably enhances radial hardness and longitudinal hardness of a filter that includes the coated plug wrap.

Any suitable hardness-enhancing coating composition may be applied to plug wrap of a filter according to the present invention. Preferably, the hardness-enhancing coating composition does not result in a coating that adversely alters the perception of taste during smoking of a smoking article that includes the coated filter. In some preferred embodiments, a hardness-enhancing coating composition comprises one or more components, such as binders or other additives, used in cigarette manufacturing. For example, the coating composition may comprise a suitable binder used in cigarette paper, tipping paper or plug wraps.

Examples of suitable materials that may be included in a hardness-enhancing coating composition are starch, polyacrylamide derivatives, styrene butadiene, styrene acrylics, dextrin, oxidized starch, ethyl cellulose, acetyl cellulose, carboxymethyl cellulose, hydroxyethyl cellulose or other suitable cellulose derivatives; pectins; guar gum; carob bean kernel meal; agar; sodium alginate or other suitable alginates; and the like. In some preferred embodiments, a hardness-enhancing coating comprises polyvinyl alcohol.

Any suitable plug wrap may be coated with a hardness-enhancing coating. Preferably, the plug wrap comprises, consists essentially of, or consists of a paper plug wrap.

The plug wrap may have any suitable basis weight. Preferably, the plug wrap has a basis weight from about 20 grams per square meter to about 180 grams per square meter. More preferably, the plug wrap has a basis weight from about 50 grams per square meter to about 150 grams per square meter; and even more preferably from about 50 grams per square meter to about 100 grams per square meter.

The plug wrap may have any suitable thickness. Suitable plug wrap papers may have a thickness of about 25 micrometers to about 200 micrometers; preferably from about 50 micrometers to about 200 micrometers. In some preferred embodiments, a plug wrap has a thickness from about 100 micrometers to about 150 micrometers.

A plug wrap with a higher weight basis and greater thickness tends to be more hard than a plug wrap with a lower weight basis and less thickness.

The plug wrap may have any suitable stiffness. Stiffness of a plug wrap may be determined by ISO 2493-1:2010: Paper and board—Determination of bending resistance—Part 1: Constant rate of deflection, ISO 2493-2:2011: Paper and board—Determination of bending resistance—Part 2: Taber-type tested, or both ISO 2493-1:2010 and ISO 2493-2:2011.

Preferably, the plug wrap has a stiffness in the machine direction with a bending effect of 15° on a length of 10 mm (MD—15° 10 mm) of 100 mN·mm or greater. For example, the plug wrap may have a stiffness (MD—15° 10 mm) from about 100 mN·mm to about 500 mN·mm. Preferably, the plug wrap has a stiffness (MD—15° 10 mm) from about 120 mN·mm to about 450 mN·mm.

Preferably, the plug wrap has a stiffness in the cross direction with a bending effect of 15° on a length of 10 mm (CD—15° 10 mm) of 40 mN·mm or greater. For example, the plug wrap may have a stiffness (CD—15° 10 mm) from about 40 mN·mm to about 250 mN·mm. Preferably, the plug wrap has a stiffness (CD—15° 10 mm) from about 50 mN·mm to about 200 mN·mm.

The plug wrap may have any suitable porosity or may even be non-porous. For example, the plug wrap may have a relatively high porosity, such as greater than about 1,000 Coresta units, or greater than about 5,000 Coresta units. In addition, or in the alternative, the plug wrap may have a porosity of less than about 10,000 Coresta units.

A filter of the present invention may include additional material, such as activated carbon; flavorants, which may be in the form of compounds, flavor threads, beads, capsules or the like; or any other suitable material. The additional material may be incorporated into the filter material or may be disposed in cavities between plugs of filter material in, for example, a plug-space-plug configuration. In such a configuration, a plug wrap as described herein may be particularly advantageous by adding enhanced structural hardness over the cavities.

Filters of the present invention may have any suitable dimensions. Typically, the filters are cylindrical in shape. Preferably, the filter has a diameter in a range from about 5 mm to about 10 mm. More preferably the diameter is between about 7.0 mm and about 8.0 mm, more preferably between about 7.7 mm and 7.8 mm. Preferably the diameter of the filter is the same or substantially the same as the diameter of the aerosol-generating article into which it is incorporated.

The length of the filter (which is the total length of the filter, including the filtration material, measured in a direction substantially parallel to the longitudinal axis of the smoking article) may have any suitable value. However, it may be convenient for the filter length to be substantially the same as in conventional smoking articles. The length designates the total length of the filter, including the plug of filtration material. That is, if the filter comprises one or more filter segments in addition to the plug of filtration material, the length is the total length of all the filter segments and the plug of filtration material. If the filter comprises only the plug of filtration material, the length is the length of only the plug of filtration material.

Longer filters tend to have greater RTD than shorter filters.

Preferably, the filter has a length between about 15 mm and about 40 mm. Even more preferably, the filter has a length between about 18 mm and about 27 mm. In one embodiment, the filter has a length of about 27 mm. In another embodiment, the filter has a length of about 21 mm.

Filters of the present invention are preferably formed using conventional filter manufacturing equipment. For example, the filter material may be formed from tow bands of filaments using conventional equipment. The plasticizer may be incorporated using conventional equipment, and the plug wrap may be disposed about the filter using convention equipment.

Filters of the present invention may be incorporated into any suitable aerosol-generating article in any suitable manner. Preferably, the filter is incorporated into an aerosol-generating article downstream of an aerosol-forming substrate material. The term "downstream" refers to relative positions of elements of the aerosol-generating article described in relation to the direction of mainstream aerosol as it is drawn from an aerosol-forming substrate and into a user's mouth.

The term "aerosol-generating article" includes cigarettes, cigars, cigarillos and other articles in which an aerosol-forming substrate, such as a tobacco, is lit and combusted to produce smoke. The term "aerosol-generating article" also includes articles in which an aerosol-forming substrate is not combusted, such as but not limited to aerosol-generating articles that heat an aerosol-forming substrate directly or indirectly, or aerosol-generating articles that use air flow or a chemical reaction, with or without a heat source, to deliver nicotine or other materials from the aerosol-generating substrate.

The filters of the present invention may be particularly desirable for use in heat-not-burn articles in which the aerosol-forming substrate is not combusted. Such articles often employ relatively short filters having low RTD. Filters in heat-not-burn products are often soft and may become softer during use as aerosol flows through the filter. In some cases, the filters may at least partially collapse or dismantle during use, which may negatively affect a consumer's perception of the quality of the article. Accordingly, by incorporating filters of the present invention in heat-not-burn articles that employ relatively short filters and low RTD, the perceived quality of the article may be improved due to the rigidity of the filter and the lack of collapse and dismantlement. Due to the increased rigidity and improved qualities of the filter, short filters that provide for relatively low filtration may be employed in heat-not-burn articles, which may provide for a taste and other sensorial qualities that are similar to conventional smoking articles such as cigarettes.

The filters of heat-not-burn articles may have any suitable length. For example, the filters may have a length of less than about 40 mm, such as between about 10 mm and about 40 mm. Preferably, the filter has a length less than about 30 mm, such as less than about 20 mm.

Referring now to the drawings, in which some aspects of the present invention are illustrated. It will be understood that other aspects not depicted in the drawings fall within the scope and spirit of the present invention. The schematic drawings are not necessarily to scale. Like numbers used in the FIGURES refer to like components, steps and the like. However, it will be understood that the use of a number to refer to a component in a given FIGURE is not intended to limit the component in another FIGURE labelled with the same number. In addition, the use of different numbers to refer to components in different FIGURES is not intended to indicate that the different numbered components cannot be the same or similar to other numbered components.

FIG. 1 is a schematic perspective view of an embodiment of a partially unrolled aerosol-generating article 10 having a filter 30. The aerosol-generating article 10, a cigarette in the depicted embodiment, is depicted as partially unrolled merely to illustrate representative components of the article. The aerosol-generating article 10 includes a rod of aerosol-forming substrate 20, such as a tobacco rod, and a filter 30 downstream of the aerosol-forming substrate 20. The filter 30 and the rod 20 are coaxially aligned with the longitudinal axis of the aerosol-generating article 10, which axis is depicted by line A-A. The depicted aerosol-generating article 10 includes a plug wrap 60, cigarette paper 40, and tipping paper 50. The cigarette paper 40 circumscribes at least a portion of the rod 20. Tipping paper 50 or other suitable wrapper circumscribes the plug wrap 60 and a portion of the cigarette paper 40 as is generally known in the art. The filter 30 includes the plug wrap 60 and filter material 32.

The exemplary embodiments described above are not limiting. Other embodiments consistent with the exemplary embodiments described above will be apparent to those skilled in the art.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

EXAMPLES

Presented below is a non-limiting example illustrating selection of filter material weight, plasticizer weight percent, and filament linear density, and plug wrap properties that resulted in enhanced filter hardness. Nineteen filters were made with cellulose acetate tow (y-shaped fibers) having different filament linear densities and different amount of plasticizer (triacetin). The resulting filter material was wrapped with plug wraps having different weight bases and thicknesses. The resulting filters had a diameter of 7.71 mm and a length of 126 mm. The materials used in making some of the nineteen filters are presented below in Table 1.

TABLE 1

| Components of tested filters | | | | | | | |
|---|---|---|---|---|---|---|---|
| Sample Number | 1 | 2 | 4 | 5 | 12 | 13 | 15 |
| Triacetin % | 7 | 7 | 7 | 10 | 7 | 10 | 10 |
| Linear wt of filament (denier) | 3 | 3.4 | 3.4 | 3.4 | 8 | 8 | 8 |
| Thickness of paper | 148 | 148 | 100 | 100 | 100 | 100 | 100 |
| Weight basis of paper | 61 | 61 | 78 | 78 | 78 | 78 | 78 |

The average radial hardness of the 126 mm long filter rods was determined as described in U.S. Published Patent Application Publication Number 2016/0128378. The RTD of the 126 mm long filter rods was measured according to ISO Standard 6565:2002. The stiffness of the plug wrap was measured according to ISO 2493-1:2010 and ISO 2493-2:2011. For some filters, the weight of the filter material and plasticizer was determined, as well as the density of the weighed material (based on the diameter of 7.71 mm). The results are presented in Table 2 below.

TABLE 2

| Properties of filters | | | | | | | |
|---|---|---|---|---|---|---|---|
| Sample Number | 1 | 2 | 4 | 5 | 12 | 13 | 15 |
| Tow + plasticizer weight (mg) | | | | 706.2 | 728.1 | | |
| Density (g/cm3) | | | | 0.119 | 0.123 | | |
| paper stiffness - MD - 15° 10 mm (mN · mm) | 135 | 135 | 323 | 323 | 323 | 323 | 323 |

TABLE 2-continued

| Properties of filters | | | | | | | |
|---|---|---|---|---|---|---|---|
| Sample Number | 1 | 2 | 4 | 5 | 12 | 13 | 15 |
| paper stiffness - CD - 15° 10 mm (mN · mm) | 75 | 75 | 165 | 165 | 165 | 165 | 165 |
| Radial hardness percent | 92.200 | 94.650 | 95.413 | 95.827 | 95.963 | 96.460 | 97.373 |
| RTD (mmWG) | 340 | 330 | 360 | 369 | 206 | 206 | 255 |
| (100 − hardness) × RTD | 2652 | 1765.5 | 1651.3 | 1539.8 | 831.6 | 729.2 | 669.9 |
| [(100 − hardness) × RTD]/mm | 21.0 | 14.0 | 13.1 | 12.2 | 6.6 | 5.8 | 5.3 |

As shown in Table 1 and Table 2, increasing the basis weight and thickness of the plug wrap tended to increase the stiffness of the plug wrap and hardness of the filter. Increasing the linear density of the filament tended to increase radial hardness. Increasing the weight percent of plasticizer also tended to increase the radial hardness.

To observe the effect of increasing the linear density on increased average radial hardness, compare, for example, sample number 1 to sample number 2, and sample numbers 4 and 5 to sample numbers 12 and 13, respectively.

Increasing the linear density of the filament and the weight percent of plasticizer tended to increase the weight and density of the filter, which correlated directly with radial hardness.

Note that the RTD is tested on filter rods having a length of 126 mm, which may be longer than those that may be used in some aerosol-generating articles. For purposes of illustration, filter 15 had an RTD of 255 mmWG, which is an RTD per mm of about 2.02, which would be expected to result in a RTD of about 42.5 mmWG for a filter having a length of 21 mm. Thus, a 21 mm long filter for filter 15 would be expected to have an average radial hardness of 97.607% (as length should not substantially affect radial hardness), while having a low RTD of about 42.5 mmWG.

A filter having such a high hardness and such low RTD is particularly desirable.

Thus, methods, systems, apparatuses, assemblies and articles for filters having enhanced hardness are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol-generating article manufacturing or related fields are intended to be within the scope of the following claims.

The invention claimed is:

1. A heat-not-burn aerosol-generating article, comprising:
a length, a diameter and a longitudinal axis;
an aerosol forming substrate; and
a filter downstream of the aerosol forming substrate, wherein the filter comprises a length and a diameter; wherein the filter comprises filter material comprising cellulose acetate filaments in the form of a plug of filter material having the same diameter as the diameter of the aerosol-generating article; wherein the length of the filter is the length of filter material; and wherein the filter material has a linear density of greater than 7 denier and a density of from 0.11 g/cm$^3$ to 0.2 g/cm$^3$,
wherein the filter has a resistance to draw of less than 70 mmWG
and wherein the aerosol forming substrate and the filter downstream of the aerosol forming substrate are aligned along the longitudinal axis of the heat-not-burn aerosol-generating article.

2. The heat-not-burn aerosol-generating article according to claim 1, wherein the density of the filter material is from 0.12 g/cm$^3$ to 0.19 g/cm$^3$.

3. The heat-not-burn aerosol-generating article according to claim 1, wherein the density of the filter material is from 0.12 g/cm$^3$ to 0.15 g/cm$^3$.

4. The heat-not-burn aerosol-generating article according to claim 1, wherein the filaments have a linear density of 8 denier.

5. The heat-not-burn aerosol-generating article according to claim 1, wherein the filter material further comprising a plasticizer.

6. The heat-not-burn aerosol-generating article according to claim 1 wherein the filter comprises a plug wrap disposed the filter material.

7. The heat-not-burn aerosol-generating article according to claim 6, wherein the filter further comprises a hardness enhancing coating on the plug wrap.

8. The heat-not-burn aerosol-generating article according to claim 7, wherein the hardness enhancing coating comprises polyvinyl alcohol.

9. The heat-not-burn aerosol-generating article according to claim 1, wherein the aerosol forming substrate comprises tobacco.

* * * * *